US005941427A

United States Patent [19]

Speer

[11] Patent Number: 5,941,427

[45] Date of Patent: Aug. 24, 1999

[54] LIQUID STORAGE CAN

[76] Inventor: Roger D. Speer, Box 204, Dighton, Kans. 67839

[21] Appl. No.: 09/108,618

[22] Filed: Jul. 1, 1998

Related U.S. Application Data

[63] Continuation of application No. 08/682,152, Jul. 17, 1996, abandoned.

[51] Int. Cl.[6] ..... B67D 5/58

[52] U.S. Cl. ..... 222/189.06; 222/481.5; 222/569; 222/570

[58] Field of Search ..... 222/189.06, 481.5, 222/569, 570, 572, 573

[56] References Cited

U.S. PATENT DOCUMENTS

| | | | |
|---|---|---|---|
| 2,849,158 | 8/1958 | Hopla | 222/569 |
| 3,309,000 | 3/1967 | Haverstick | 222/569 |
| 3,695,488 | 10/1972 | Olsson | 222/570 |
| 3,899,107 | 8/1975 | Gaal | 222/570 |
| 4,014,466 | 3/1977 | Ritter | 222/563 |
| 4,034,901 | 7/1977 | Kirk | 222/481.5 |
| 4,240,568 | 12/1980 | Pool | 222/570 |
| 4,736,874 | 4/1988 | Durant | 222/570 |
| 4,813,579 | 3/1989 | Ciumaga | 222/570 |
| 4,907,714 | 3/1990 | Gatz | 220/90 |
| 4,911,319 | 3/1990 | DeJean | 220/4 A |
| 4,941,586 | 7/1990 | Tarna | 220/83 |
| 5,078,872 | 1/1992 | Durant et al. | 222/569 |
| 5,123,576 | 6/1992 | Lawrence | 222/570 |
| 5,195,662 | 3/1993 | Neff | 222/108 |
| 5,267,675 | 12/1993 | Cane | 222/556 |

FOREIGN PATENT DOCUMENTS

| | | | |
|---|---|---|---|
| 564063 | 9/1958 | Canada | 222/570 |

*Primary Examiner*—Joseph A. Kaufman
*Attorney, Agent, or Firm*—Chase & Yakimo, L.C.

[57] ABSTRACT

A storage can for ready-to-use liquid consumer products, such as paint, enamel and liquid resins. The storage can includes a cylindrical body forming a side wall, a bottom wall and a lid member attached to an open end of the body. A pour spout is formed in the side wall and extends outwardly therefrom a distance no greater than the distance at which perpendicular tangents to the can body intersect. The spout extends upwardly from the body to the point at which the lid member lies and preferably includes a filter member therein. The open end of the body presents a flat, annular rim from which a first gripping member extends with a second gripping member formed around the outer circumference of the lid to mate with the first gripping member and secure the lid to the open end. The lid member preferably includes a spout lid portion hingeably attached thereto to selectively open and close only the spout opening. Also, the lid member preferably includes a vent opening formed therethrough substantially opposite the pour spout.

14 Claims, 9 Drawing Sheets

LIQUID STORAGE CAN

This application is a continuation of application Ser. No. 08/682,152, filed Jul. 17, 1996 now abandoned.

FIELD OF THE INVENTION

This invention relates to storage cans for ready-to-use liquid consumer products, such as paint, enamel and liquid resins. More specifically, the can includes a pour spout configured to allow easy storage and stacking thereof.

BACKGROUND OF THE INVENTION

Storage cans for ready-to-use liquid consumer products such as paint, enamel and liquid resins are very awkward, cumbersome and messy, especially for pouring purposes. Typically, these cans have a recessed ring formed in the can's circumference and do not include a spout. Upon pouring, the paint or other liquid flows into the recessed ring, around the top of the can and runs down the side of the can creating a mess of spilled paint or other liquid. This is a recurring problem each time more paint or liquid is poured from within the can. Although cans exist that include pouring spouts which make pouring any liquid from within the can easier, the spouts prevent the cans from being easily and efficiently stored within packing boxes and other confined areas.

SUMMARY OF THE INVENTION

Accordingly, a primary object of the subject invention is to provide a storage can for liquid having a pour spout that extends outwardly from the can a distance no greater than the distance at which perpendicular tangents to the can intersect.

Another object of the subject invention is to provide a storage can for liquid having a spout that extends upwardly to the lid of the can.

Yet another object of the subject invention is to provide a liquid storage can from which the liquid is easily and efficiently poured.

Still another object of the subject invention is to provide a liquid storage can presenting a flat, annular ring at its open end for easy pouring of the liquid therein.

Still another object of the subject invention is to provide a storage can that is easily and efficiently stored in confined places, especially packing boxes.

These objects are attained by providing a storage can for liquid, comprising a cylindrical body forming a side wall, a bottom wall and a lid member attached to an open end of the body. A pour spout is formed in the side wall and extends outwardly therefrom a distance no greater than the distance at which perpendicular tangents to the can body intersect. The spout extends upwardly from the body to the plane in which the lid member lies and preferably includes a filter member therein. The open end of the body presents a flat, annular rim from which a first gripping member extends with a second gripping member formed around the outer circumference of the lid to mate with the first gripping member and secure the lid to the open end. The lid member preferably includes a spout lid portion hingeably attached thereto to selectively open and close only the spout opening. Also, the lid member preferably includes a vent opening formed therethrough substantially opposite the pour spout, for easy pouring of the liquid without removal of the lid.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
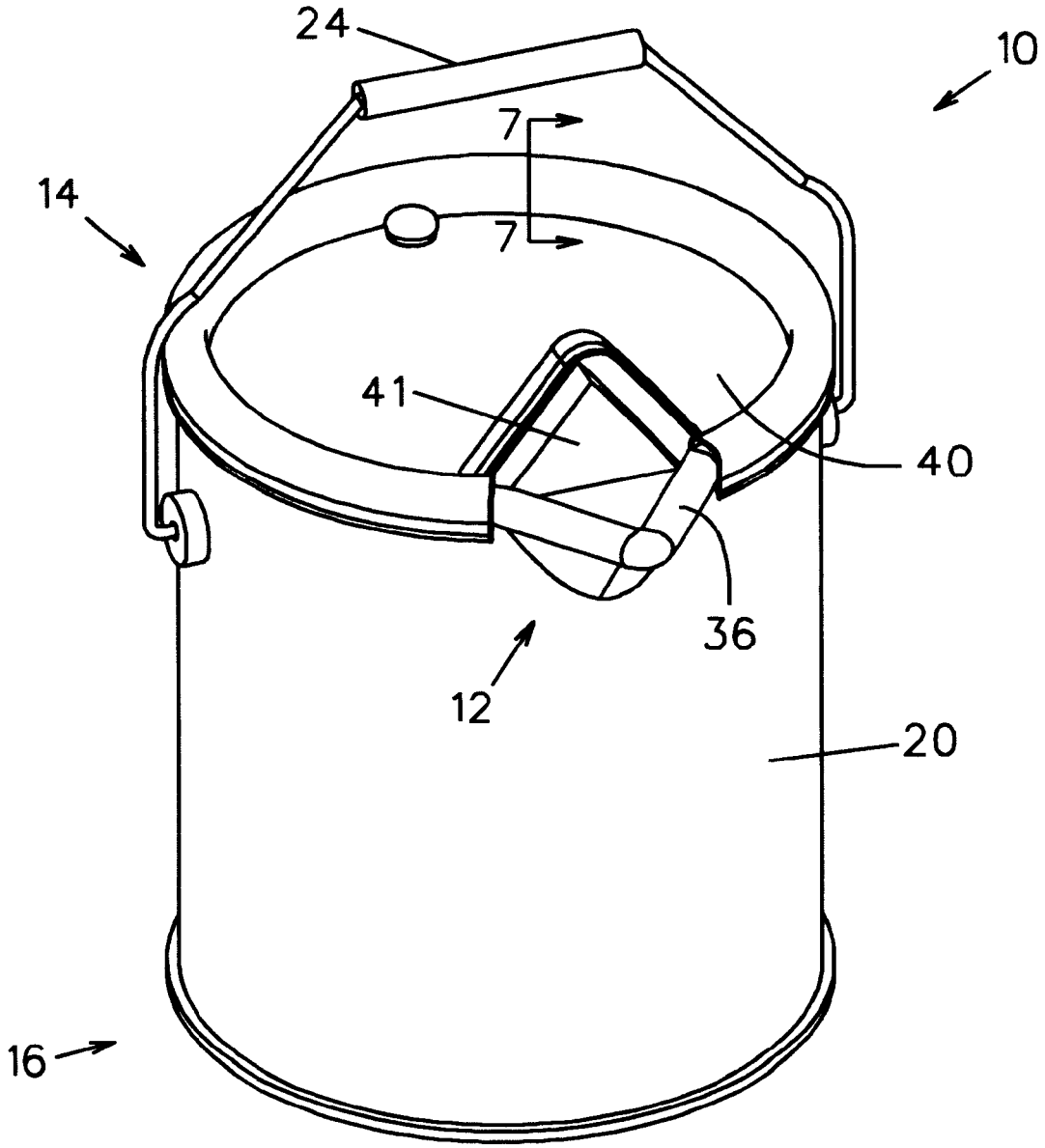
FIG. 1 is a front perspective view of a storage can for liquid in accordance with the present invention.
Figure 2:
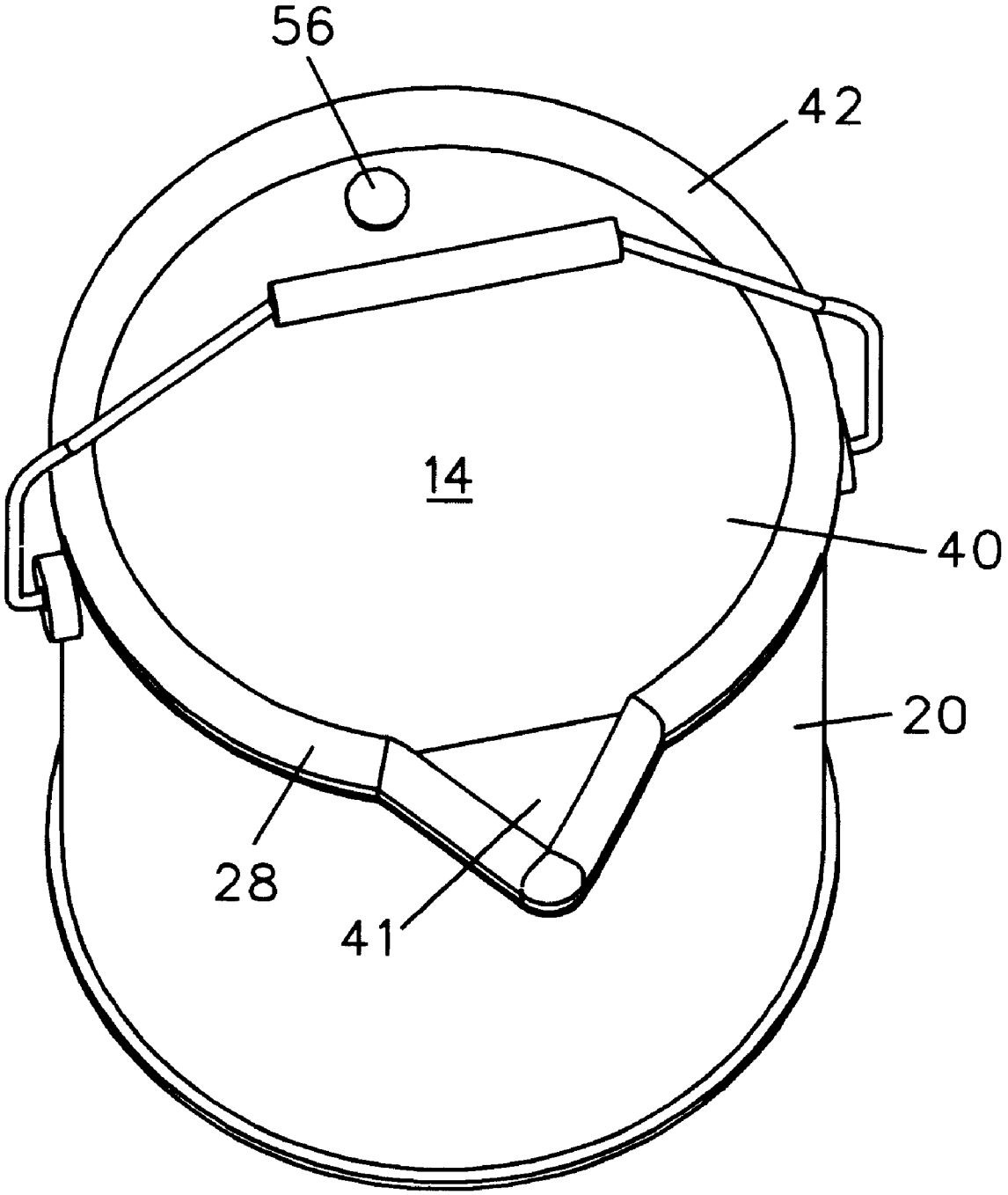
FIG. 2 is a top perspective view of the storage can of FIG. 1.

Liquid storage can 10, as seen in FIG. 1, is preferably for use with ready-to-use liquid consumer products, such as paint, enamel and liquid resins. Can 10 includes features, such as spout 12, lid 14 and bottom wall 16, that allow the liquid to be poured from within can 10 easily, without creating any mess. Furthermore, spout 12 is configured to allow easy storage and packing of a plurality of cans 10 within confined places, such as rectangular storage boxes.

Figure 8:
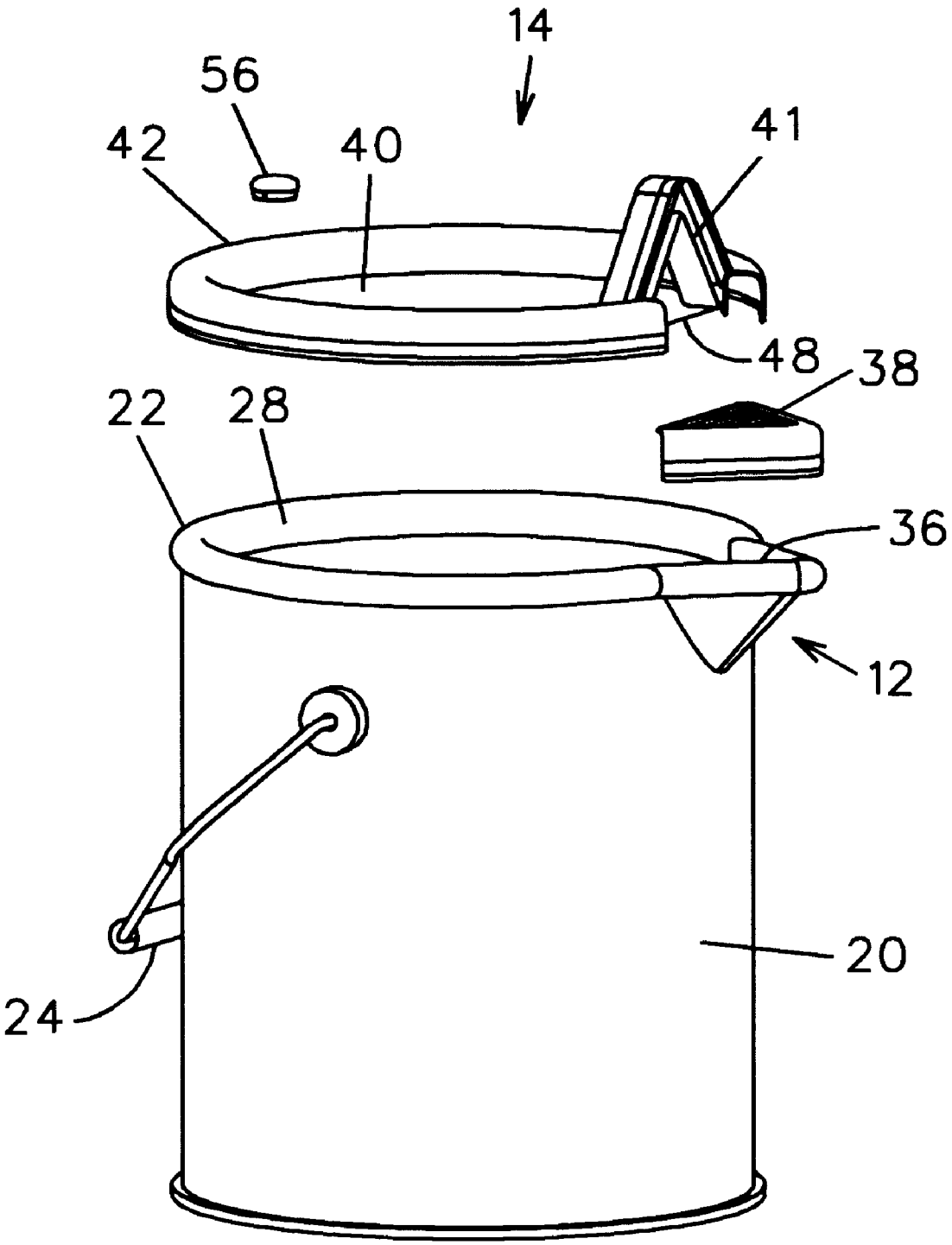
FIG. 8 is an exploded perspective view of the can of FIG. 1.
Figure 9:
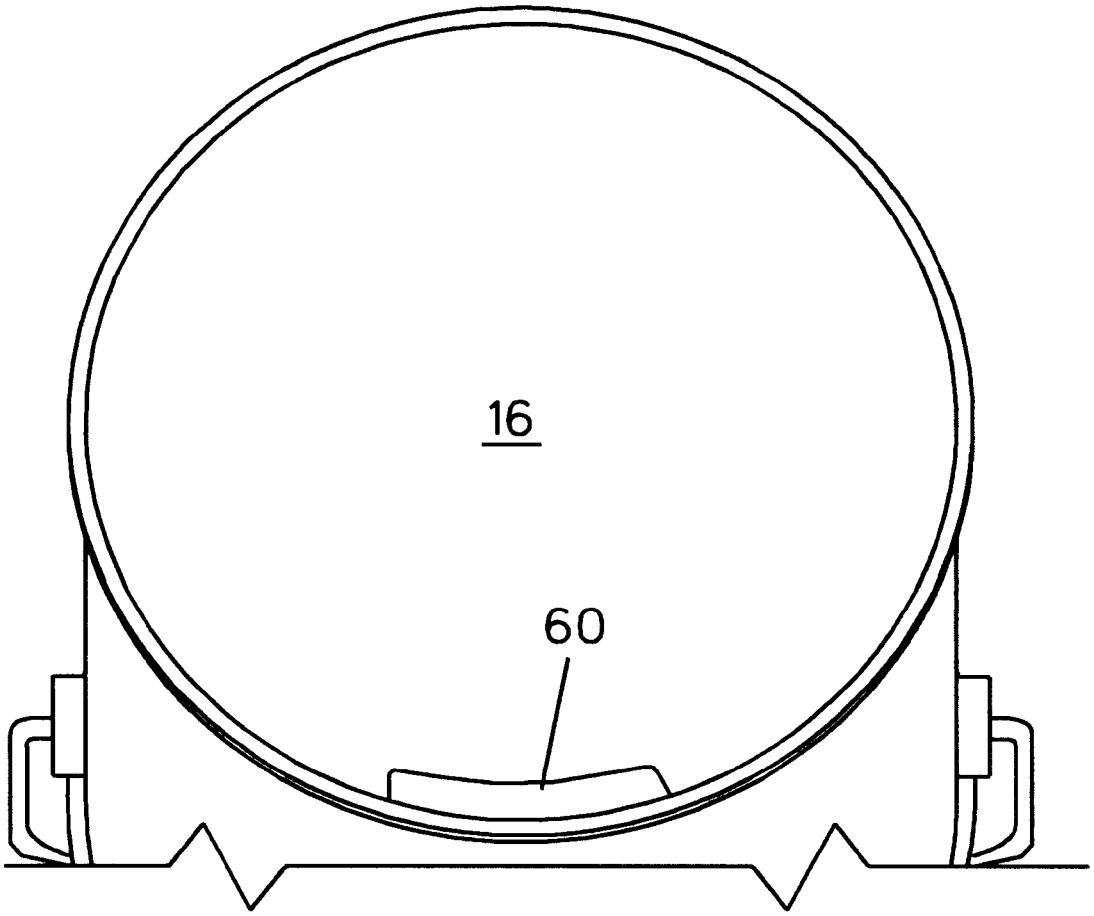
FIG. 9 is a partial bottom perspective view showing the finger slot.

Can 10 is cylindrical and includes a body portion 20 that presents a circumferential side wall, except at spout 12, as seen in FIGS. 1–3, 8. Body or side wall 20 forms an open end 22, and is closed at its other end by bottom wall 16, as seen in FIG. 9. Handle 24 is mounted to side wall 20 and is similar to a typical paint can handle.

Figure 7:
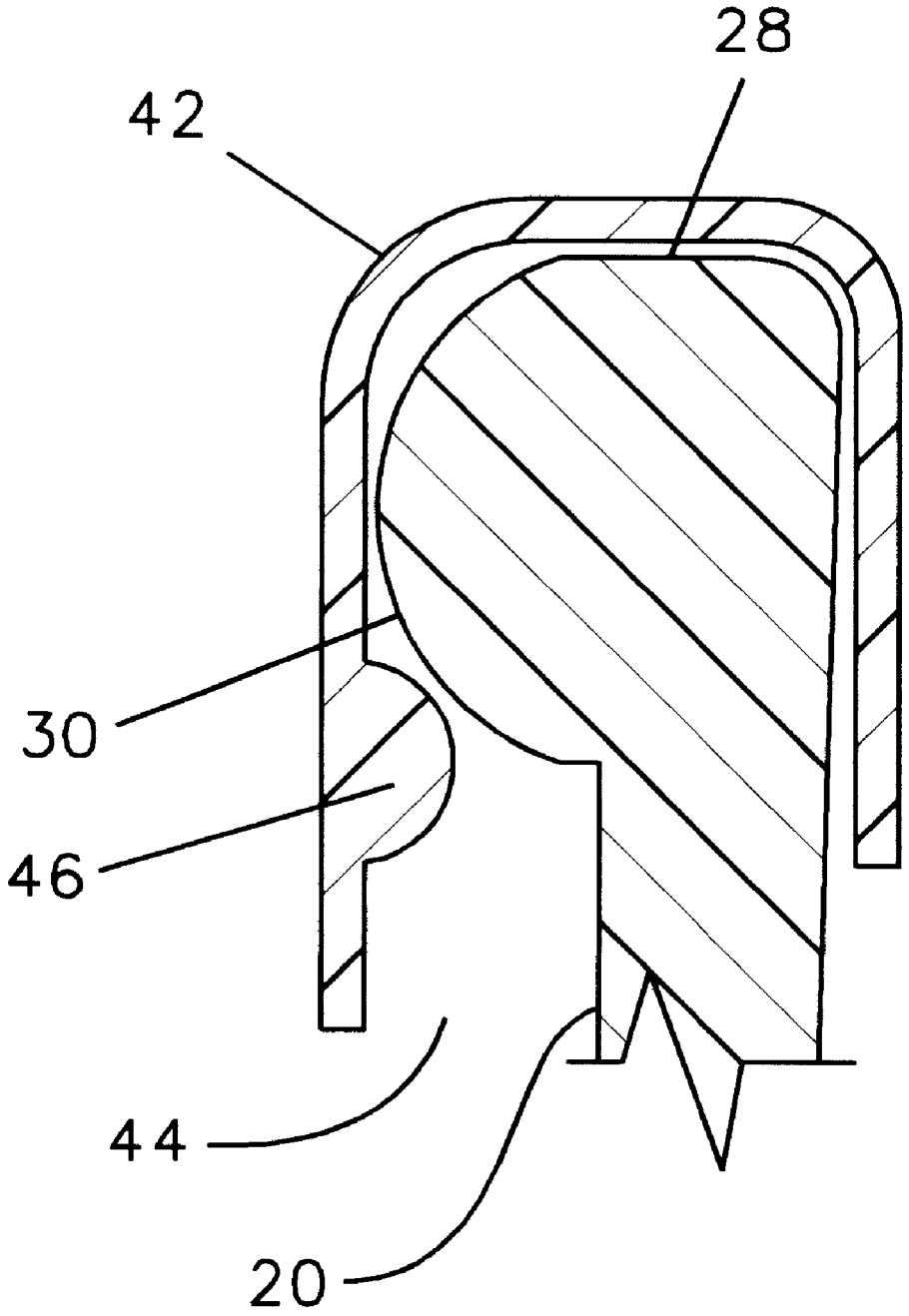
FIG. 7 is a cross-sectional view taken along line 7—7' of FIG. 1 showing the mating gripping members.

Open end 22 presents a continuous, annular rim 28 which extends around the circumference thereof and around the top surface 36 of spout 12, as seen in FIGS. 2–4, 7–8. A gripping bead 30 extends radially outwardly from the flat, annular rim surface and downwardly to converge with side wall 20 of can 10 or spout 12, as seen in FIG. 7. The flat top surface of annular rim 28 facilitates the easy and clean removal and replacement of lid onto open end 22 since open end 22 does not include any grooves or recesses therein.

Figure 3:
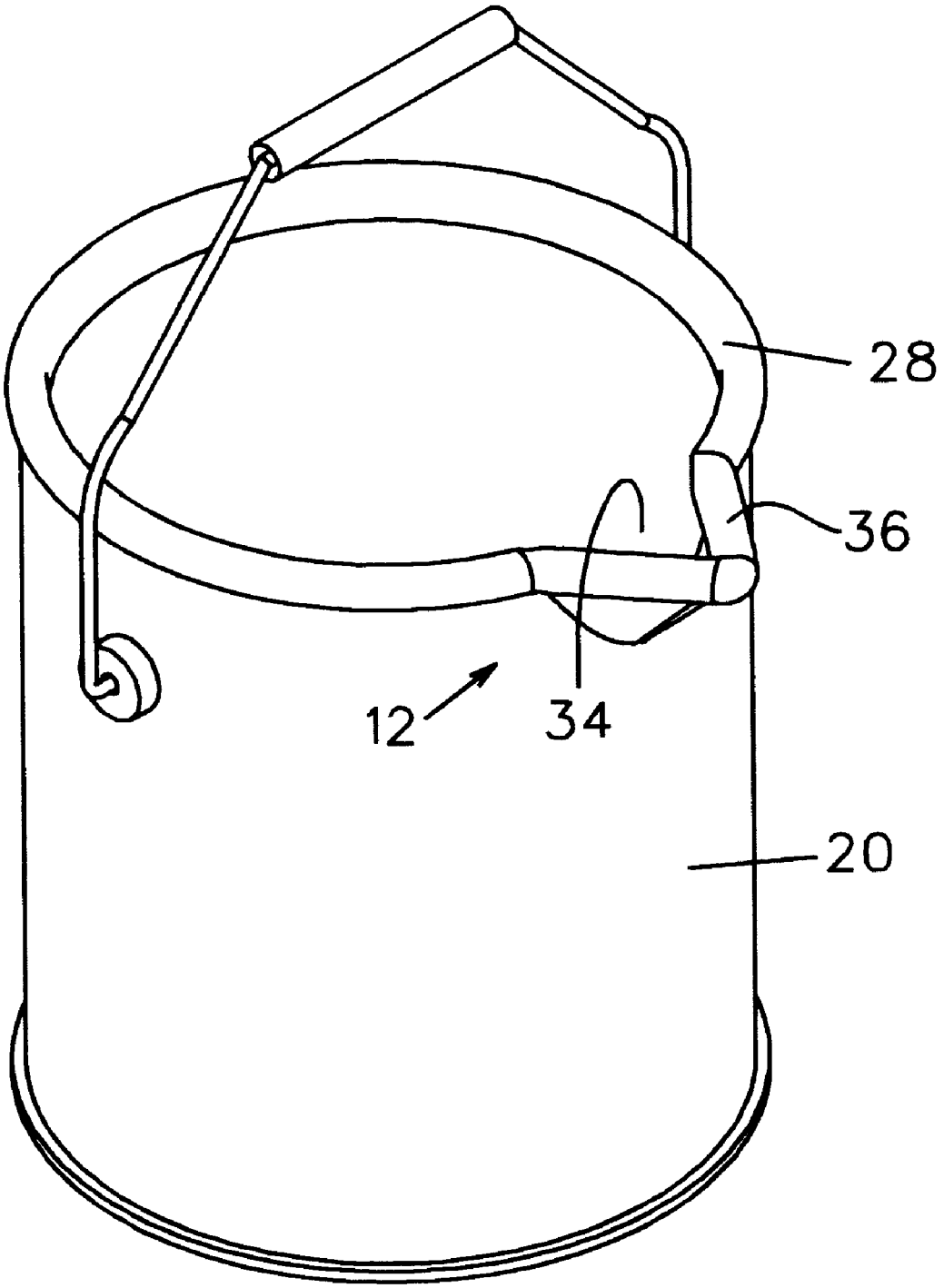
FIG. 3 is a perspective view of the can of FIG. 1 with the lid removed therefrom.
Figure 4:
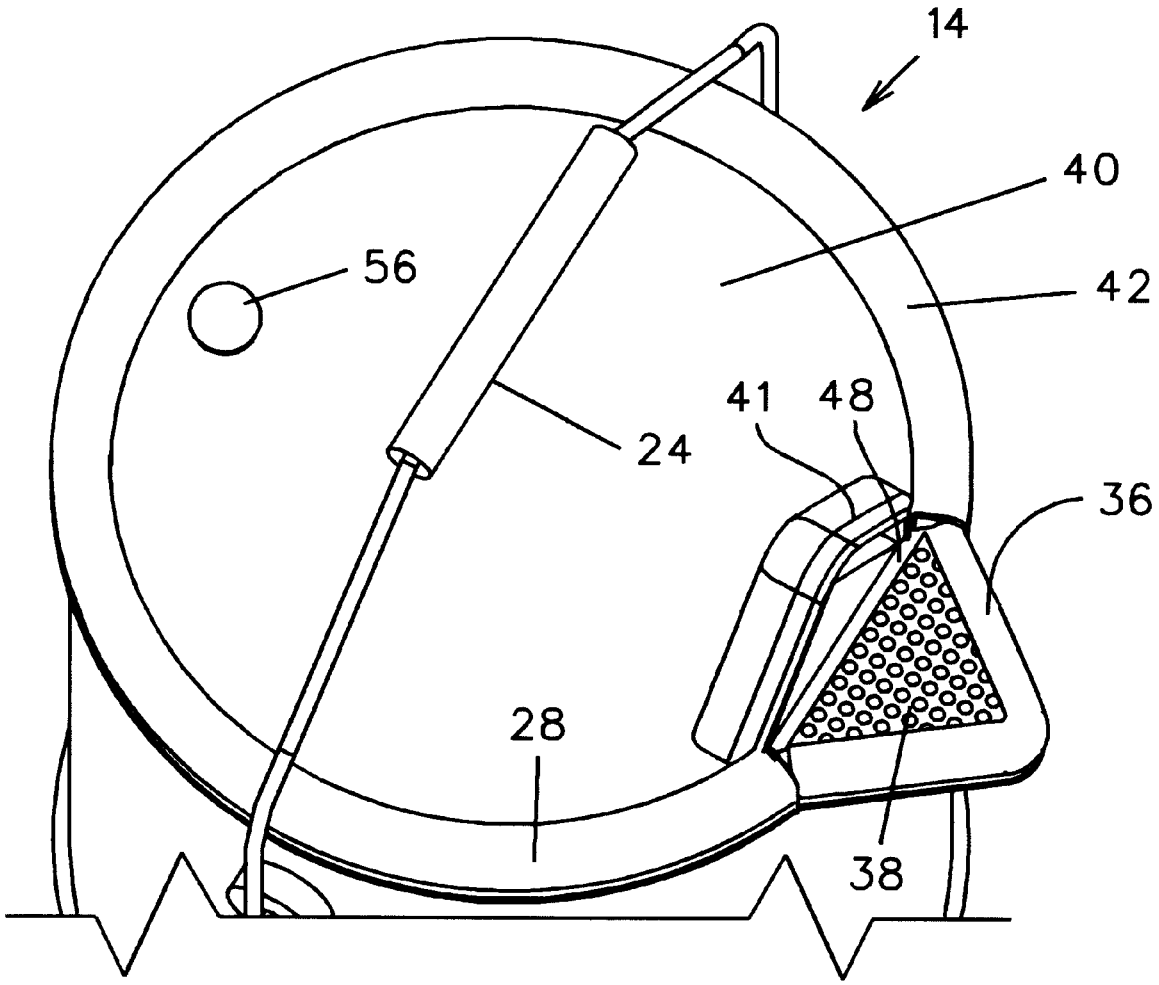
FIG. 4 is an enlarged top perspective view of the can showing the hinged spout lid and the filter within the spout.

Spout 12 is preferably unitarily and integrally formed in side wall 20 of can 10 by molding. Spout 12 preferably forms a triangularly-shaped pouring member, as seen in FIGS. 1, 3 and 4, by which the liquid within can 10 is easily poured. Thus, spout includes a spout opening 34, as in FIG. 3. Spout 12 preferably includes filter member 38 therein, as seen in FIGS. 4 and 8. Filter 38 may be molded within spout or may be removable therefrom for easy replacement if filter 38 becomes clogged. Such a removable filter 38 may be formed of rubber latex which would easily snap over the top of peripheral surface 36 of spout 12 for use until replacement becomes necessary.

Spout 12 extends outwardly from side wall 20 no further than the distance at which two perpendicular tangents to can 10 intersect. Spout 12 also extends upwardly from side wall 20 and terminates in the same plane as open end 22. Thus, can 10 is easily stored and stacked. As seen in FIGS. 1–3, 8, spout opening 34 communicates with open end 22. Alternatively, spout opening may be spaced from open end 22.

Lid 14 includes body portion 40 and spout portion 41. Spout portion 41 is pivotally attached to body portion 40 at hinge 48. Body portion 40 extends over open end 22 of can 10 and spout portion 41 extends over spout 12, as seen in FIGS. 1, 2, 4 and 8.

Lid 14 generally forms a flat, top surface to can 10 but includes an outer rim 42, which extends around the lid's circumference and the spout's periphery and is molded to mate with gripping bead 30. Outer rim 42 is annular and rounded to present a grooved recess 44. Nose 46 extends within recess 44 to mate with gripping bead 30 as seen in FIG. 7. Thus, when lid 14 is secured to can 10, nose 46 and gripping bead 30 provide an air tight seal between lid 14, can 10 and spout 12 to prevent any spillage of the liquid within can 10. Lid 14 is removable from open end 22 of can 10 and spout opening 34 by unsnapping outer rim 42 of lid 14 from open end 22.

Figure 5:
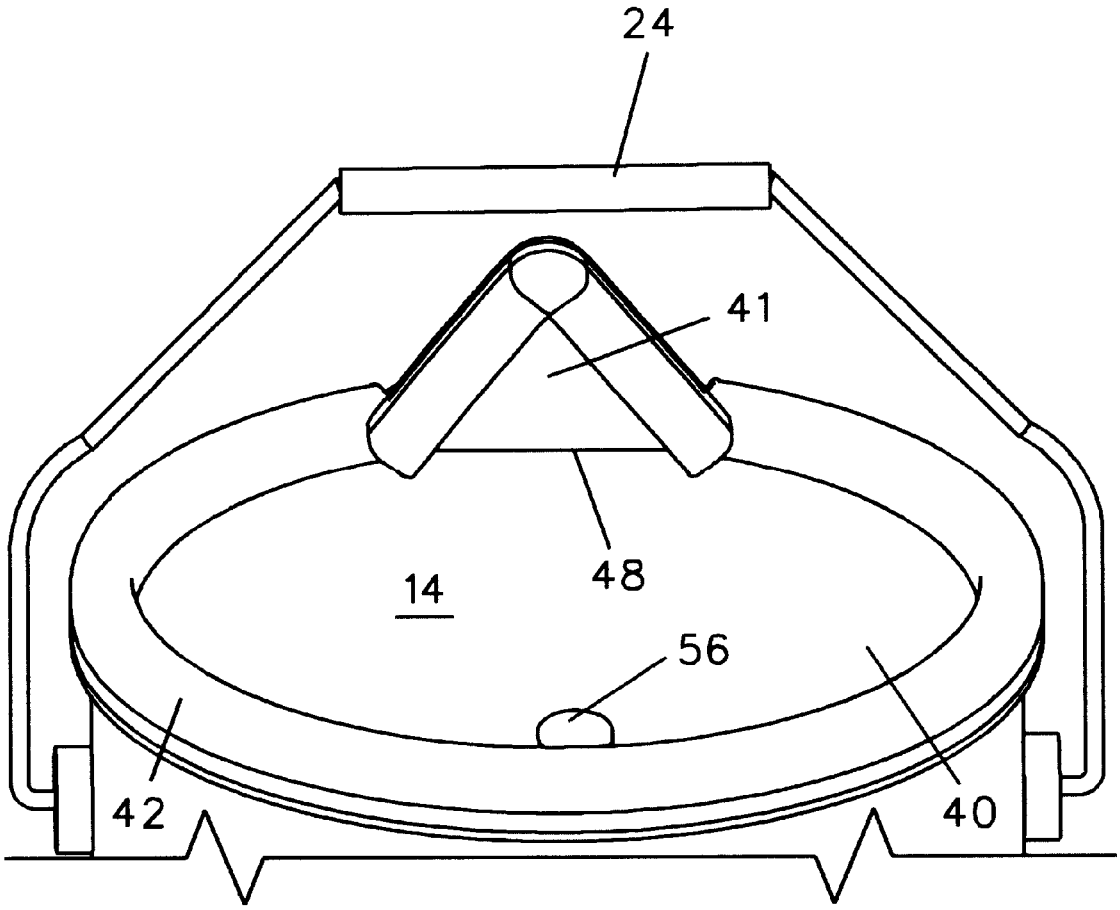
FIG. 5 is a rear perspective view of FIG. 4.
Figure 6:
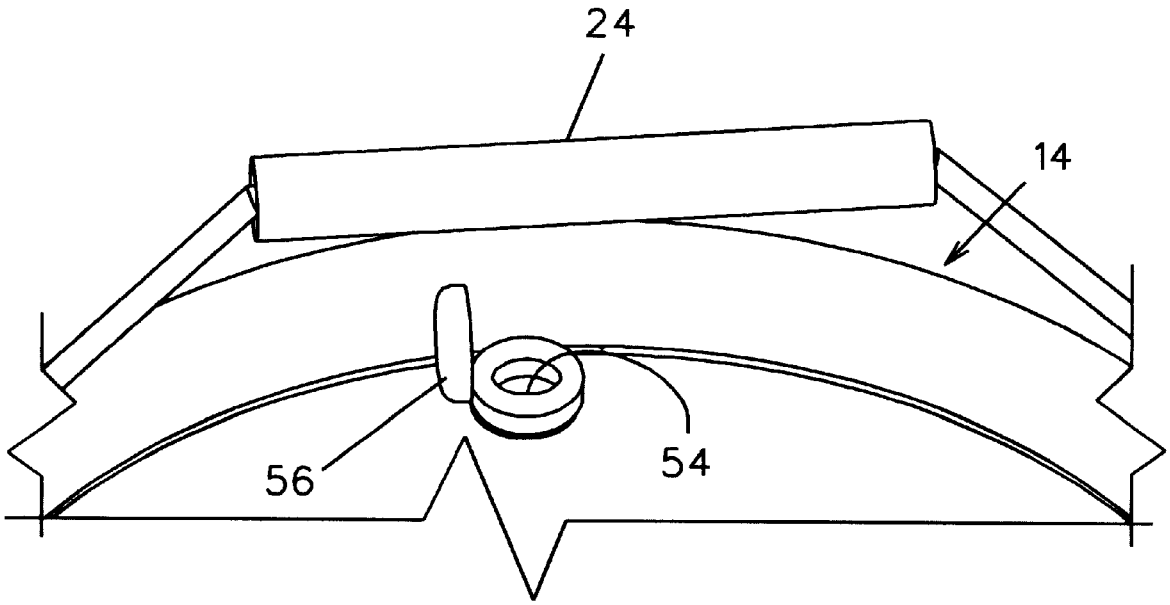
FIG. 6 is a partial perspective view showing the vent opening within the can's lid.

Alternatively, only spout portion 41 of lid 14 can be opened by unsnapping outer rim 42 of lid 14 and pivoting spout portion 41 about its hinge 48, as seen in FIGS. 4, 5 and 8. Hinge 48 is formed along the intersection of spout 12 and open end 22 of can 10 by scoring lid 14 along that length, which allows lid 14 to flex easily.

Vent opening 54 extends through body 40 of lid 14 opposite spout portion 41 and includes a vent cap 56 for selectively opening and closing the vent opening 54, as seen in FIGS. 2, 4–6. Vent 54 is typically opened when only spout portion 41 of lid 14 is opened or pivoted from spout 12. Vent 54 increases the flow of liquid from within can 10 to facilitate the pouring thereof.

Bottom wall 16 of can 10 may include a finger slot 60 molded therein, as seen in FIG. 9 opposite spout 12. Slot 60 allows the user to place up to four fingers therein for improved balance and control of the can while pouring the liquid therefrom.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. A storage can for liquid, comprising:

a cylindrical body presenting a circumference and having an opening therein and a bottom wall;

a pour spout presenting another opening extending outwardly from said body opening a distance no greater than the distance at which perpendicular tangents to said body intersect; and a lid being releasably attached to an open end of said body and over said pour spout and being hinged at said pour spout opening to selectively open only said pour spout opening.

2. A storage can as claimed in claim 1, wherein said pour spout extends upwardly from said body to a plane containing said lid member.

3. A storage can as claimed in claim 1, wherein said pour spout includes a filter member therein.

4. A storage can as claimed in claim 1, wherein said lid includes a vent opening formed therethrough.

5. A storage can as claimed in claim 1, wherein said vent opening is formed substantially opposite said pour spout.

6. A storage can as claimed in claim 1, wherein said open end of said body presents a flat annular rim from which a first gripping member extends.

7. A storage can as claimed in claim 6, wherein said lid includes a second gripping member which mates with said first gripping member to secure said lid to said open end.

8. A storage can as claimed in claim 1, wherein said bottom member includes a finger recess formed therein.

9. A storage can for liquid, comprising:

a cylindrical body having a side wall and a bottom wall which form an opening in said body and presenting a diameter;

a pour spout presenting another opening extending angularly outwardly from said body a distance substantially the distance at which perpendicular tangents to said body intersect, and said pour spout opening being in communication with said body opening;

a lid releasably attached over said pour spout and to said body over said open end thereof, opposite said bottom wall;

said lid having a hinged portion at an intersection of said pour spout opening and said opening for selectively opening and closing said pour spout opening.

10. A storage can as claimed in claim 9, wherein said bottom wall has a finger recess formed therein.

11. A storage can as claimed in claim 9, wherein said lid includes a vent opening therethrough to facilitate pouring liquid from said can.

12. A storage can as claimed in claim 9, wherein said pour spout includes a filter therein.

13. A storage can, comprising:

a cylindrical can member having an open end to which a lid releasably attaches and having an angularly extending spout extending therefrom and presenting a spout opening in communication with said open end;

a flat annular rim having a flat top surface extending from said open end and said spout, from which a gripping bead extends;

said lid having a gripping member formed to mate with said gripping bead and attach said lid to said open end of said can;

said lid including a hingeably attached spout lid portion extending from the intersection of said spout and said open end of said can over said spout to selectively open and close said spout, said spout lid portion having a first position generally planar with said lid for closing said spout and a second position away from said planar position for opening said spout.

14. A storage can as claimed in claim 13, wherein said spout extends angularly outwardly from said can a distance substantially equal to the distance at which perpendicular tangents extending from said can intersect, and extends upwardly to said lid.

* * * * *